US008287255B2

(12) United States Patent
Yokoi et al.

(10) Patent No.: US 8,287,255 B2
(45) Date of Patent: Oct. 16, 2012

(54) VARIABLE DISPLACEMENT ROTARY PUMP

(75) Inventors: Hironao Yokoi, Aichi-ken (JP); Shigeru Suzuki, Aichi-ken (JP); Katsumi Yamashita, Aichi-ken (JP); Toshiro Fujii, Aichi-ken (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 361 days.

(21) Appl. No.: 12/546,438

(22) Filed: Aug. 24, 2009

(65) Prior Publication Data

US 2010/0054963 A1 Mar. 4, 2010

(30) Foreign Application Priority Data

Aug. 26, 2008 (JP) ..... 2008-216264

(51) Int. Cl.
*F04B 49/24* (2006.01)

(52) U.S. Cl. ..... 417/426; 417/286; 417/302; 417/427; 417/428

(58) Field of Classification Search ..... 417/426–428, 417/283, 286, 302, 295, 441
See application file for complete search history.

(56) References Cited

U.S. PATENT DOCUMENTS

| | | | | |
|---|---|---|---|---|
| 3,884,039 | A * | 5/1975 | Pourian | 60/445 |
| 4,502,845 | A * | 3/1985 | Chana | 417/288 |
| 5,110,269 | A * | 5/1992 | Fallon | 417/428 |
| 2004/0213680 | A1 | 10/2004 | Suzuki | |
| 2009/0041593 | A1 | 2/2009 | Yokoi | |
| 2009/0041594 | A1 | 2/2009 | Yokoi | |

FOREIGN PATENT DOCUMENTS

| | | | |
|---|---|---|---|
| JP | 11-082322 | A | 3/1999 |
| JP | 2002-70757 | A | 3/2002 |

* cited by examiner

*Primary Examiner* — Devon Kramer
*Assistant Examiner* — Dominick L Plakkoottam
(74) *Attorney, Agent, or Firm* — Woodcock Washburn LLP

(57) ABSTRACT

A variable displacement rotary pump includes a main pump unit, an auxiliary pump unit, a discharge passage, a bypass passage, a suction passage, a check valve and a control valve. The suction passage is in communication with the discharge passage through the bypass passage and a second discharge port. The check valve is disposed in the discharge passage for preventing fluid in a first discharge port of the main pump unit from flowing into the bypass passage. The control valve is operable for opening and closing the bypass passage. When the control valve opens the bypass passage and the check valve closes the discharge passage, flow rate of the fluid discharged from the discharge passage is reduced. A throttle passage is provided in the bypass passage or the control valve for regulating flow of the fluid in early phase of operation of the control valve to open the bypass passage.

12 Claims, 6 Drawing Sheets

VARIABLE DISPLACEMENT ROTARY PUMP

CROSS-REFERENCE TO RELATED APPLICATION

This application claims priority to Japanese Application No. 2008-216264 filed Aug. 26, 2008.

BACKGROUND OF THE INVENTION

The present invention relates to a variable displacement rotary pump having a plurality of pump units wherein the displacement of the pump can be varied.

Japanese Unexamined Patent Application Publication No. 2002-70757 discloses a variable displacement gear pump that is a type of variable displacement rotary pump. The variable displacement gear pump of this publication has a drive gear and two driven gears that are meshed with the drive gear in a casing of the gear pump, thus forming a dual pump unit including a first pump unit and a second pump unit.

To be more specific, the first pump unit has a first discharge port and the second pump unit has a second discharge port, respectively, and the variable displacement gear pump includes an outlet port that is common to the first and second pump units and a check valve that is provided between the common outlet port and the second discharge port of the second pump unit. The common outlet port is connected to a hydraulic drive system for feeding oil. The variable displacement gear pump further includes an unloading passage (oil return passage), one end of which is connected to the second discharge port and the check valve and the other end of which is connected to the suction port of the second pump unit. The unloading passage is provided with a solenoid valve.

When the solenoid valve is closed, the first pump unit and the second pump unit are operated in parallel, so that the pump is operated at a large displacement. When the solenoid valve is open, the second pump unit is unloaded, so that the pump is operated at a small displacement.

In order to reduce the amount of oil fed to the hydraulic drive system, the solenoid valve of the pump needs to be operated to open the unloading passage. When the solenoid valve opens the unloading passage, the pressure in the unloading passage is reduced to the same level as that in the suction port of the second pump unit because the unloading passage is connected to the suction port of the second pump unit. The check valve is provided between the first discharge port of the first pump unit and the unloading passage to prevent the oil discharged from the first pump unit from flowing backward into the unloading passage.

During the operation of the pump at a large displacement when the oil in the second pump unit is discharged from the common outlet port, however, the check valve is opened. If the unloading passage is opened by the solenoid valve with the check valve opened, time lag occurs before the check valve is closed. Therefore, a large amount of the oil discharged from the first pump unit is flowed back into the unloading passage through the opening of the check valve before the check valve is closed completely. If the check valve is closed while a large amount of oil is being flowed back into the unloading passage, oil hammer which is typical of a variable displacement gear pump occurs by stopping flow of a large amount of oil suddenly. The oil hammer is propagated as a shock wave through the oil passage at a high speed, so that there is fear that any external hydraulic circuit or device or the pump itself may be damaged.

For preventing such oil hammer in the variable displacement gear pump, the check valve may be closed before a large amount of oil flows backward. Alternatively, the check valve may be closed slowly so that flow of a large amount of oil is not stopped suddenly. Because the check valve is operated by resilient force, however, neither of the methods can be used effectively.

The present invention is directed to a variable displacement rotary pump that prevents generation of oil hammer in changing the operation of the rotary pump from a large displacement to a small displacement.

SUMMARY OF THE INVENTION

In accordance with an aspect of the present invention, there is provided a variable displacement rotary pump that includes a main pump unit, an auxiliary pump unit, a discharge passage, a bypass passage, a suction passage, a check valve, a control valve and a throttle passage. The main pump unit has a first discharge port and the auxiliary pump unit has a second discharge port. The discharge passage is in communication with the first discharge port and the second discharge port. Fluid in the first discharge port and fluid in the second discharge port join together in the discharge passage and are then discharged from the discharge passage. The bypass passage is in communication with the second discharge port. The suction passage is in communication with the bypass passage. The check valve is disposed in the discharge passage for preventing the fluid in the first discharge port from flowing into the bypass passage. The check valve is operated by pressure of the second discharge port. The control valve is operable for opening and closing the bypass passage. When the control valve opens the bypass passage and the check valve closes the discharge passage, flow rate of the fluid that is discharged from the discharge passage is reduced. The throttle passage is provided in the bypass passage or the control valve for regulating flow of the fluid in early phase of operation of the control valve to open the bypass passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
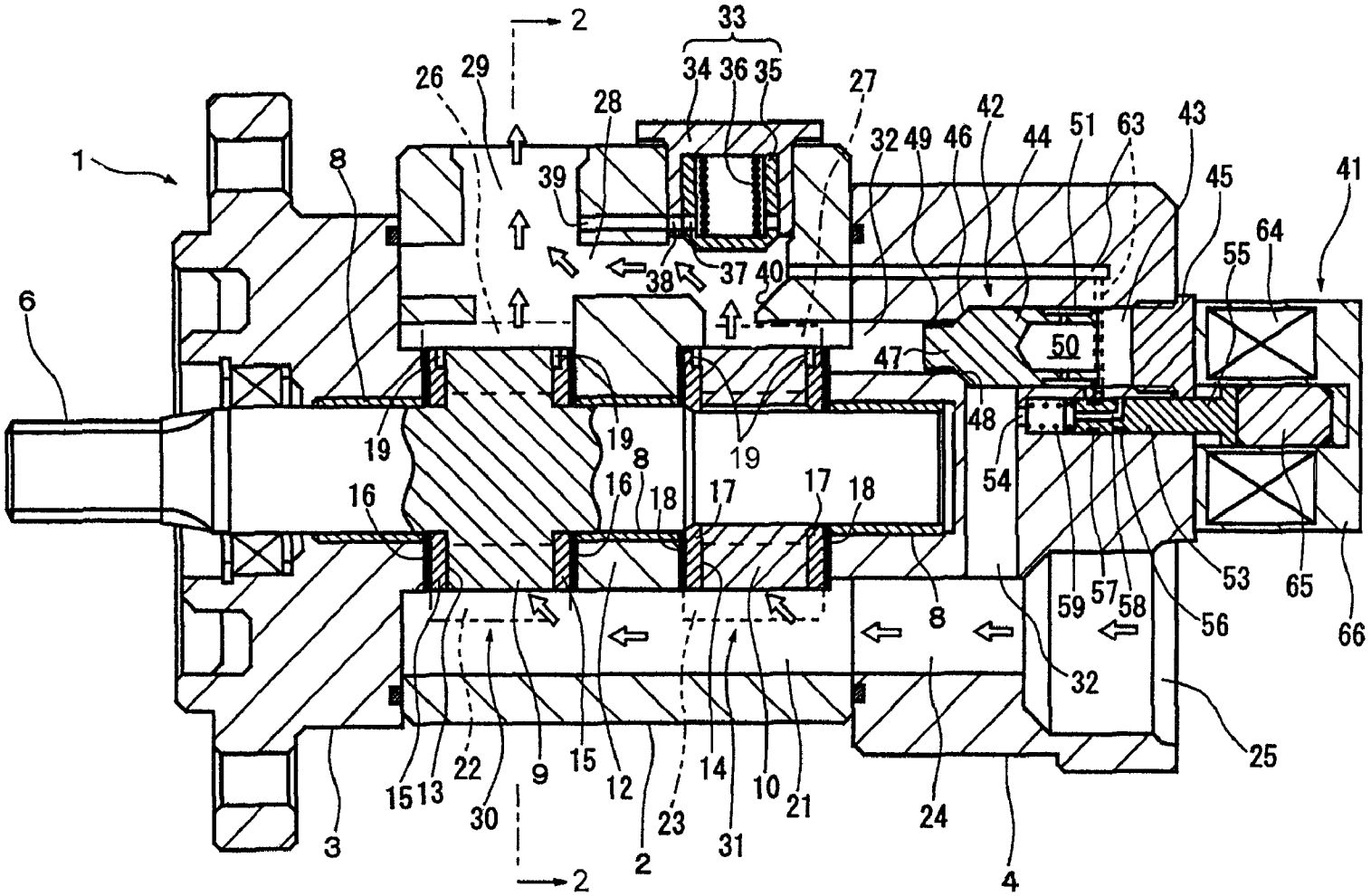
FIG. 1 is a longitudinal sectional view showing a variable displacement gear pump according to a first embodiment of the present invention.

The following will describe the variable displacement gear pump according to the first embodiment of the present invention with reference to FIGS. 1 to 6. The variable displacement gear pump will be referred to merely as a gear pump hereinafter. It is noted that the left-hand side and the right-hand side of the gear pump as viewed in FIG. 1 correspond to the front and the rear of the gear pump, respectively. Referring to FIG. 1 showing the gear pump in its longitudinal sectional view, the gear pump has a housing indicated generally by reference numeral 1 and including a body 2 located in the middle thereof, a front housing 3 joined to the front end of the body 2, and a rear housing 4 joined to the rear end of the body 2. These housing components are connected together by a plurality of bolts 5 (shown in FIG. 2). It is also noted that the upper side and the lower side of the gear pump as viewed in FIG. 1 correspond to the upper side and the lower side of the gear pump, respectively, when installed in place. The gear pump uses oil as a fluid to be pumped.

Figure 2:
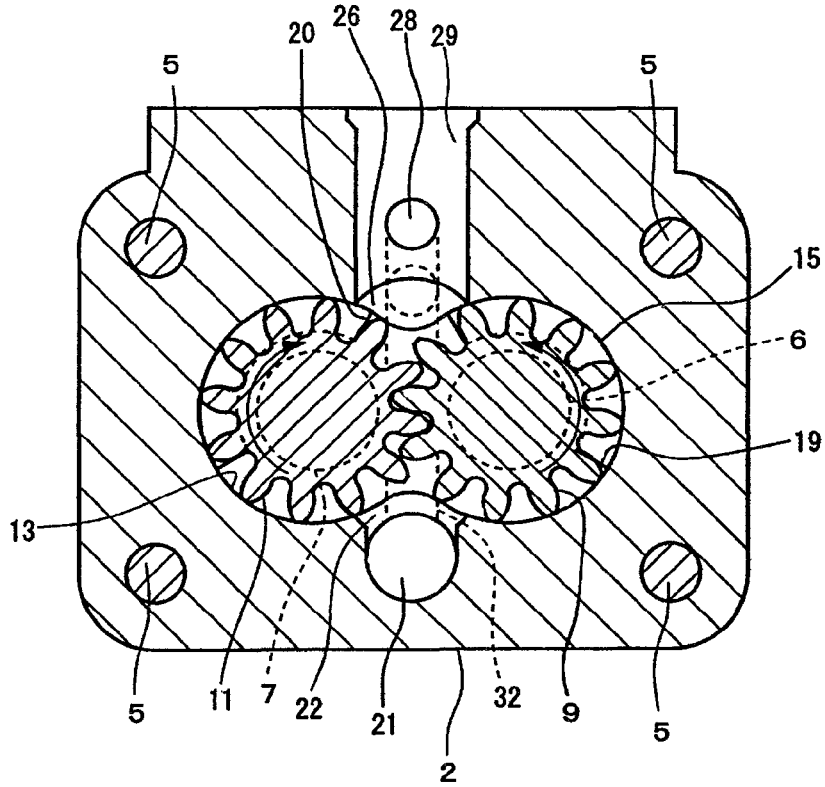
FIG. 2 is a cross sectional view showing the variable displacement gear pump as taken along the line 2-2 of FIG. 1.

Referring to FIG. 2, a drive shaft 6 and a driven shaft 7 extend parallel to each other through the body 2. The drive shaft 6 and the driven shaft 7 are rotatably supported by the body 2, the front housing 3 and the rear housing 4 through bearings 8. The drive shaft 6 has a first drive gear 9 formed integrally therewith and a second splined drive gear 10 mounted on the drive shaft 6 through spline engagement. Similarly, the driven shaft 7 has a first driven gear 11 formed integrally therewith and a second splined driven gear (not shown) mounted on the driven shaft 7 through spline engagement. The front end of the drive shaft 6 extends out from the front housing 3 and is connected to an external power source (not shown).

The body 2 has therein a first gear chamber 13 and a second gear chamber 14 separated by a partition 12. The first gear chamber 13 is hermetically formed between the front surface of the partition 12 and the rear surface of the front housing 3. The second gear chamber 14 is hermetically formed between the rear surface of the partition 12 and the front surface of the rear housing 4. As shown in FIG. 2, the first gear chamber 13 is roughly formed in the shape of kidney as viewed in the axial direction of the drive shaft 6. The first drive gear 9 and the first driven gear 11 are disposed in the first gear chamber 13 in engagement with each other. The second gear chamber 14 is formed in the same manner as the first gear chamber 13. The second drive gear 10 and the second driven gear (not shown) are also disposed in the second gear chamber 14 in engagement with each other.

A side plate 15 and a gasket 16 in the shape of the same kidney as the first gear chamber 13 are interposed between the front surfaces of the first drive gear 9 and the first driven gear 11 and the rear surface of the front housing 3 and also between the rear surfaces of the first drive gear 9 and the first driven gear 11 and the front surface of the partition 12, respectively. Similarly, a side plate 17 and a gasket 18 in the shape of the same kidney as the first gear chamber 13 are interposed between the front surfaces of the second drive gear 10 and the second driven gear (not shown) and the rear surface of the partition 12 and also between the rear surfaces of the second drive gear 10 and the second driven gear (not shown) and the front surface of the rear housing 4, respectively.

As shown in FIG. 1, each side plate 15 has in the surface thereof in contact with the first drive gear 9 a recess 19. As shown in FIG. 2, the recess 19 of the side plate 15 is formed in an arcuate shape so as to cover the gear teeth of the first drive gear 9 in the region corresponding to about one third of one revolution of the first drive gear 9 in a clockwise direction as seen in FIG. 2 from the discharge side (the upper side of FIG. 2) of a main pump unit (which will be described later). Similarly, each side plate 15 has in the surface thereof in contact with the first driven gear 11 a recess 20. The recess 20 of the side plate 15 is formed in an arcuate shape so as to cover the gear teeth of the first driven gear 11 in the region corresponding to about one third of one revolution of the first driven gear 11 in a counterclockwise direction as seen in FIG. 2 from the discharge side (the upper side of FIG. 2) of the main pump unit (which will be described later).

Similarly, each side plate 17 has in the surface thereof in contact with the second drive gear 10 another recess 19. The recess 19 of the side plate 17 is formed in an arcuate shape so as to cover the gear teeth of the second drive gear 10 in the region corresponding to about one third of one revolution of the second drive gear 10 from the discharge side of an auxiliary pump unit (which will be described later). Similarly, each side plate 17 has in the surface thereof in contact with the second driven gear (not shown) another recess 20. The recess 20 of the side plate 17 is formed in an arcuate shape so as to cover the gear teeth of the second driven gear (not shown) in the region corresponding to about one third of one revolution of the second driven gear (not shown) from the discharge side of the auxiliary pump unit (which will be described later).

As the first drive gear 9 and the first driven gear 11 rotate in the first gear chamber 13, their corresponding recesses 19 and 20 receive oil that is transferred along the inner periphery of the first gear chamber 13 and discharge the oil into the discharge side of the main pump unit (which will be described later). As the second drive gear 10 and the second driven gear (not shown) rotate in the second gear chamber 14, their corresponding recesses 19 and 20 receive oil that is transferred along the inner periphery of the second gear chamber 14 and discharge the oil into the discharge side of the auxiliary pump unit (which will be described later). The gaskets 16 serve to prevent the first drive gear 9 and the first driven gear 11 from being moved in the axial direction of the drive shaft 6. The gaskets 18 serve to prevent the second drive gear 10 and the second driven gear (not shown) from being moved in the axial direction of the drive shaft 6.

A first suction port 22 and a second suction port 23 are formed in the body 2 below the first gear chamber 13 and the second gear chamber 14, respectively. A suction passage 21 is formed in the lower part of the body 2, extending parallel to the drive shaft 6 and in communication with the first suction port 22 and the second suction port 23. A suction passage 24 and an inlet port 25 are formed in the lower part of the rear housing 4. The suction passage 21 is in communication with an external oil tank (not shown) via the suction passage 24 and the inlet port 25.

A first discharge port 26 and a second discharge port 27 are formed in the body 2 above the first gear chamber 13 and the second gear chamber 14, respectively. A discharge passage 28 is formed in the upper part of the body 2, extending parallel to the drive shaft 6 and in communication with the first discharge port 26 and the second discharge port 27. Thus, the oil that is discharged from the first gear chamber 13 to the first discharge port 26 and the oil that is discharged from the second gear chamber 14 to the second discharge port 27 join together in the discharge passage 28. The oil in the discharge passage 28 is then supplied through an outlet port 29 formed in the body 2 to a hydraulic circuit (not shown) that is connected to an external hydraulic device (not shown). It is noted that the first gear chamber 13, the first suction port 22 and the first discharge port 26 cooperate to form a main pump unit 30. The second gear chamber 14, the second suction port 23 and the second discharge port 27 cooperate to form an auxiliary pump unit 31.

The second discharge port 27 is in communication with a bypass passage 32 that is formed in the rear housing 4 and in communication with the suction passage 24. The bypass passage 32 includes a first passage that is parallel to the drive shaft 6 and a second passage that is bent from the first passage and perpendicular to the drive shaft 6. The second passage of the bypass passage 32 serves as the area of the bypass passage 32 of the present invention that is located downstream of the control valve 42. It is noted that the bypass passage 32 may be in direct communication with the suction passage 21. A check valve 33 is disposed in the discharge passage 28 and located closer to the auxiliary pump unit 31 than to the main pump unit 30. When the check valve 33 closes the discharge passage 28, the oil discharged from the main pump unit 30 and the oil discharged from the auxiliary pump unit 31 are prevented from joining together in the discharge passage 28.

The check valve 33 includes a cylindrical valve body 34 with the top end closed, a cylindrical valve member 35 with the bottom end closed and a coiled compression spring 36. The cylindrical valve body 34 has on the outer circumference thereof an external thread. The cylindrical valve member 35 is slidably fitted in the valve body 34 through the opened end of the valve body 34. The compression spring 36 is provided between the closed end of the valve body 34 and the closed end of the valve member 35. Although the strength of the compression spring 36 may be freely set, the speed of the valve member 35 in closing the discharge passage 28 is increased with an increase of the strength of the compression spring 36. The valve member 35 has therethrough at a position adjacent to the closed bottom end a hole 37. The valve body 34 also has therethrough at a position adjacent to the opened bottom end a hole 38. The body 2 has in the upper part thereof a communication hole 39 that is opened to the outlet port 29.

The holes 37, 38 and the communication hole 39 are in communication with each other when the valve member 35 is moved to its uppermost position (or when the check valve 33 opens the discharge passage 28 maximally). With the three holes 37, 38 and 39 thus set in communication with each other, part of the oil in the outlet port 29 flows into the valve member 35, which is then subjected to the downward force due to the urging force of the compression spring 36 and the pressure of the oil in the valve member 35. The body 2 is provided at a position above the second discharge port 27 with a valve seat 40 that is formed in the discharge passage 28. As the valve member 35 is lowered and brought into contact with the valve seat 40, the communication between the main pump unit 30 and the auxiliary pump unit 31 via the discharge passage 28 is shut off. When the valve member 35 is lowered, the oil discharged from the main pump unit 30 flows into the valve member 35 through the hole 37 which is then in communication with the discharge passage 28. Therefore, the valve member 35 is still subjected to the downward force due to the pressure of the oil in the valve member 35.

The rear housing 4 has therein a valve hole 43 that extends from the rear end of the first passage of the bypass passage 32 to the rear end of the rear housing 4 and provides a passage that is larger in diameter than the bypass passage 32. A cylindrical valve member 44 with the front end closed is slidably fitted in the valve hole 43. The valve hole 43 is hermetically sealed at the rear end thereof by a sealing bolt 45. The valve hole 43 and the valve member 44 cooperate to form a control valve 42. A solenoid operated pilot valve 41 is provided at the rear end of the rear housing 4 for controlling the operation of the control valve 42.

The valve member 44 has at a position adjacent to the front end thereof a valve portion 46 in the form of a truncated cone. The valve member 44 has at the front end thereof a cylindrical front end portion 47 formed with a diameter that is smaller than that of the bypass passage 32. When the valve member 44 is moved forward such that the cylindrical front end portion 47 is inserted in the bypass passage 32, the clearance formed between the outer circumferential surface of the cylindrical front end portion 47 and the inner peripheral surface of the first passage of the bypass passage 32 provides a throttle passage 49, which extends parallel to the axis of the valve member 44. The forward-most position of the valve member 44 is restricted by a valve seat 48 that is formed in the bypass passage 32.

The cross sectional area of the throttle passage 49 that determines the regulation of the flow of oil and the length thereof that determines the time taken to regulate the flow of oil are set depending on the speed of the valve member 35 of the check valve 33 in closing the discharge passage 28. In this structure, the flow rate of oil flowing from the bypass passage 32 to the suction passage 24 is prevented from being increased rapidly. The valve member 44 has therein a space 50 that is opened to the valve hole 43. The valve member 44 has on the outer circumferential surface thereof an annular groove 51 with a predetermined length in the longitudinal direction of the valve member 44. The annular groove 51 is in communication with the space 50 through an appropriate number of holes 52.

Figure 3:
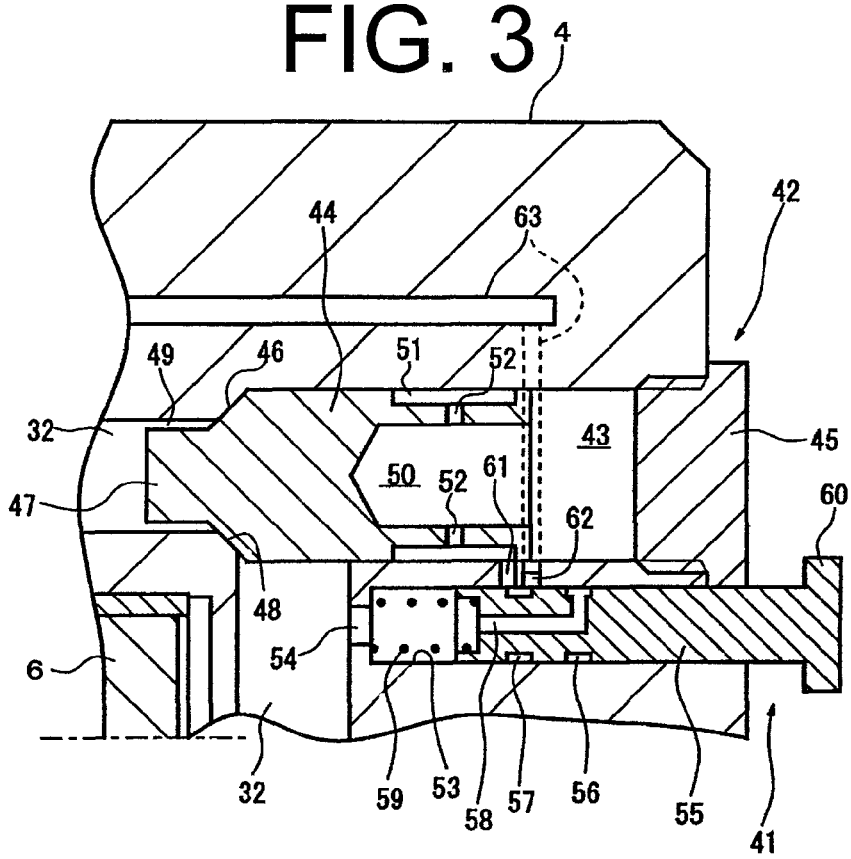
FIG. 3 is an enlarged cross sectional fragmentary view showing a control valve of the variable displacement gear pump of FIG. 1.

Referring to FIG. 3, the following will describe the solenoid operated pilot valve 41. The rear housing 4 has therein a valve hole 53 and a communication hole 54 that are located below the valve hole 43 of the control valve 42. The valve hole 53 is opened at the rear end of the rear housing 4. The valve hole 53 is in communication with the second passage of the bypass passage 32 through the communication hole 54 and has a larger diameter than the communication hole 54. A cylindrical spool valve 55 is slidably fitted in the valve hole 53 and adapted to move in the longitudinal direction of the spool valve 55.

The spool valve 55 has on the outer circumferential surface adjacent to the front end thereof two annular grooves 56 and 57. The groove 56 is located behind the groove 57. The spool valve 55 has therein an axial communication passage 58. The communication passage 58 is opened at the front end thereof to the valve hole 53. The communication passage 58 is bent at the rear end thereof in the radial direction of the spool valve 55 and connected to the rear groove 56. A coiled compression spring 59 is located in the valve hole 53 and urges the spool valve 55 rearward. The spool valve 55 extends out from the rear end of the rear housing 4 and has at the rear end thereof a flange 60 that is larger in diameter than the valve hole 53. When the spool valve 55 is moved forward against the compression spring 59, therefore, the forward-most position of the spool valve 55 is restricted by the flange 60.

The rear housing 4 is formed with a hole 61, a groove 62 and a communication passage 63. The valve hole 53 is in communication with the valve hole 43 via the hole 61 and also in communication with the groove 62. The communication passage 63 is connected at the front end thereof to the discharge passage 28 and at the rear end thereof to the groove 62. The hole 61, the groove 62, the annular grooves 56 and 57 are arranged as follows. The hole 61 is in constant communication with the annular groove 51 irrespective of the position of the valve member 44. When the spool valve 55 is moved to its forward-most position, the hole 61 is in communication with the annular groove 56. When the spool valve 55 is moved to its rearward-most position, the hole 61 is in communication with the annular groove 57. The annular groove 57 in communication with the hole 61 is also in communication with the groove 62.

A case 66 having an electromagnet 64 and a plunger 65 is fixed to the rear housing 4 at the rear end thereof by any suitable means. The flange 60 of the spool valve 55 is inserted in the hole of the case 66 in which the plunger 65 is slidably moved. The flange 60 is in contact at the rear surface thereof with the front surface of the plunger 65. Therefore, when the electromagnet 64 is energized, the spool valve 55 is moved forward by the plunger 65. When the electromagnet 64 is deenergized, the spool valve 55 is moved rearward by the urging force of the compression spring 59.

The following will describe the operation of the variable displacement gear pump of the first embodiment. The main pump unit 30 and the auxiliary pump unit 31 have substantially the same displacement. When only the oil discharged from the main pump unit 30 is discharged from the gear pump through the outlet port 29, the pump is operated at its small or 50% displacement. When the oil discharged from the main pump unit 30 and the auxiliary pump unit 31 is all discharged from the gear pump through the outlet port 29, the pump is operated at its large or 100% (maximum) displacement. Thus, the gear pump of the first embodiment is operable at two different modes in accordance with the load of the hydraulic device. In the first mode, the gear pump is operated at the 50% displacement. In the second mode, the gear pump is operated at the 100% displacement.

FIGS. 1 through 3 show the gear pump operating at the 100% displacement. In the second mode operation of the gear pump, the electromagnet 64 is deenergized and the spool valve 55 is positioned rearward by the compression spring 59. Therefore, the annular groove 57 is in communication with the hole 61 and the groove 62. In addition, the control valve 42 is so positioned as to close the bypass passage 32 by the pressure of the discharge oil.

When external drive force is applied to the drive shaft 6, the first drive gear 9 and the second drive gear 10 are rotated in the counterclockwise direction and the first driven gear 11 and the second driven gear (not shown) meshed with the first drive gear 9 and the second drive gear 10, respectively, are rotated in the clockwise direction, as indicated by arrows of FIG. 2. In accordance with the rotation of the gears, the oil in the suction passage 21 is drawn into the first gear chamber 13 through the first suction port 22 and into the second gear chamber 14 through the second suction port 23.

The oil drawn into the first gear chamber 13 is trapped in the spaces that are formed between the gear teeth of the first drive gear 9 and the inner peripheral surface of the first gear chamber 13. The oil drawn into the first gear chamber 13 is also trapped in the spaces that are formed between the gear teeth of the first driven gear 11 and the inner peripheral surface of the first gear chamber 13. The oil trapped in the spaces is discharged to the first discharge port 26. Similarly, the oil drawn into the second gear chamber 14 is trapped in the spaces that are formed between the gear teeth of the second drive gear 10 and the inner peripheral surface of the second gear chamber 14. The oil drawn into the second gear chamber 14 is also trapped in the spaces that are formed between the gear teeth of the second driven gear (not shown) and the inner peripheral surface of the second gear chamber 14. The oil trapped in the spaces is discharged to the second discharge port 27. The oil discharged to the first and second discharge ports 26 and 27 joins together in the common discharge passage 28 and is delivered to the external hydraulic circuit (not shown) through the outlet port 29. Thus, the oil is increased in pressure in accordance with load of the external hydraulic circuit and/or the hydraulic device (not shown).

Part of the oil discharged from the first discharge port 26 to the discharge passage 28 flows into the space of the valve member 35 through the communication hole 39 and the holes 38 and 37, so that the discharge pressure of the oil and the urging force of the compression spring 36 act on the valve member 35 in the direction to close the discharge passage 28. On the other hand, the discharge pressure of the oil flowing from the second discharge port 27 to the discharge passage 28 and the pressure caused by the pressure loss of the oil flow in closing of the bypass passage 32 act on the valve member 35 in the direction to open the discharge passage 28. Therefore, the pressure acting on the valve member 35 is balanced by contraction of the compression spring 36, so that the check valve 33 is kept opened.

Part of the oil in the discharge passage 28 flows into the communication passage 63 and then into the space 50 of the valve member 44 through the groove 62, the annular groove 57, the hole 61, the annular groove 51 and the hole 52 of the valve member 44 while the oil in the space 50 is prevented from flowing into the second passage of the bypass passage 32. Thus, the valve portion 46 of the valve member 44 is brought into contact with the valve seat 48 by the discharge pressure of the oil, so that the bypass passage 32 is kept closed. Therefore, the oil discharged from the second discharge port 27 of the auxiliary pump unit 31 flows into the discharge passage 28 and joins the oil discharged from the first discharge port 26 of the main pump unit 30. Thus, all oil is supplied from the outlet port 29 to the external hydraulic circuit (not shown).

Figure 4:
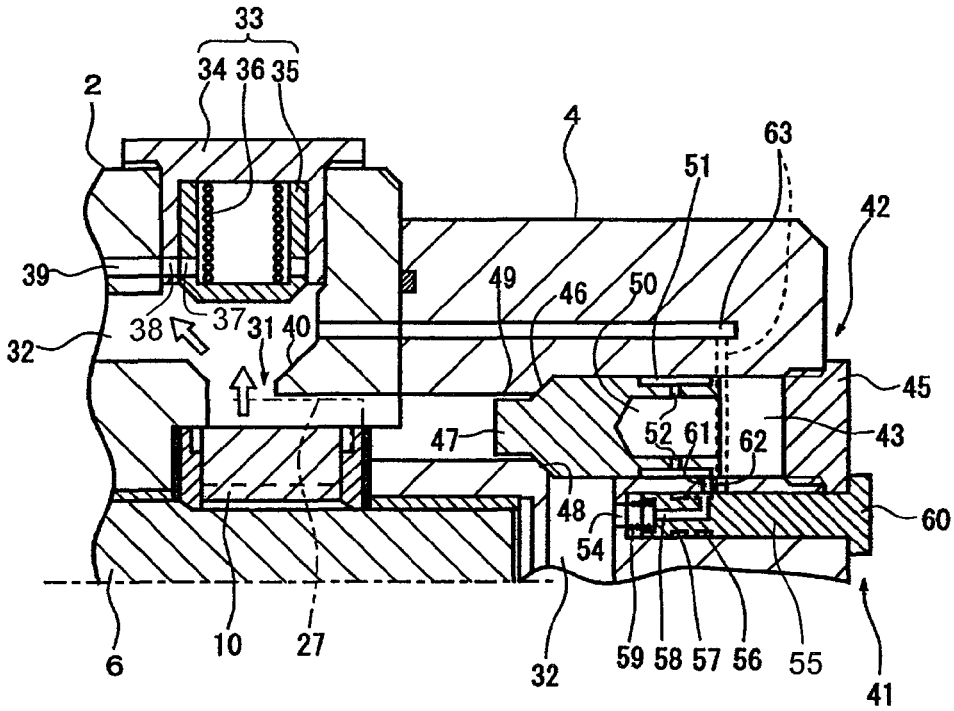
FIG. 4 is an enlarged cross sectional fragmentary view showing a check valve and the control valve of the variable displacement gear pump in operation at 100% displacement.
Figure 5:
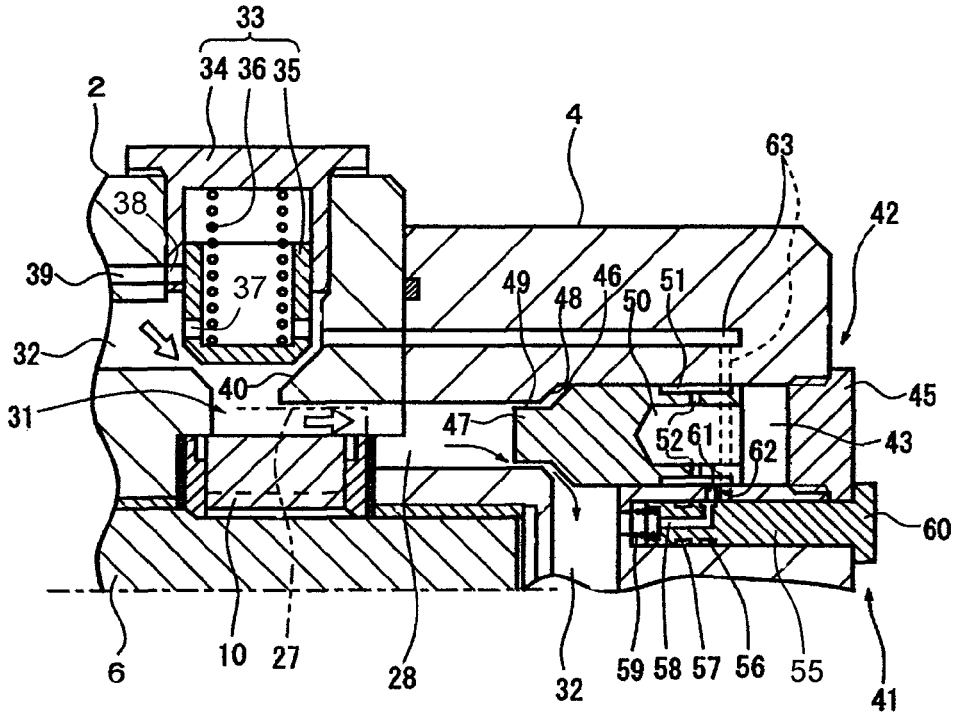
FIG. 5 is an enlarged cross sectional fragmentary view showing the check valve and the control valve when operation of the variable displacement gear pump is changed from 100% displacement to 50% displacement.
Figure 6:
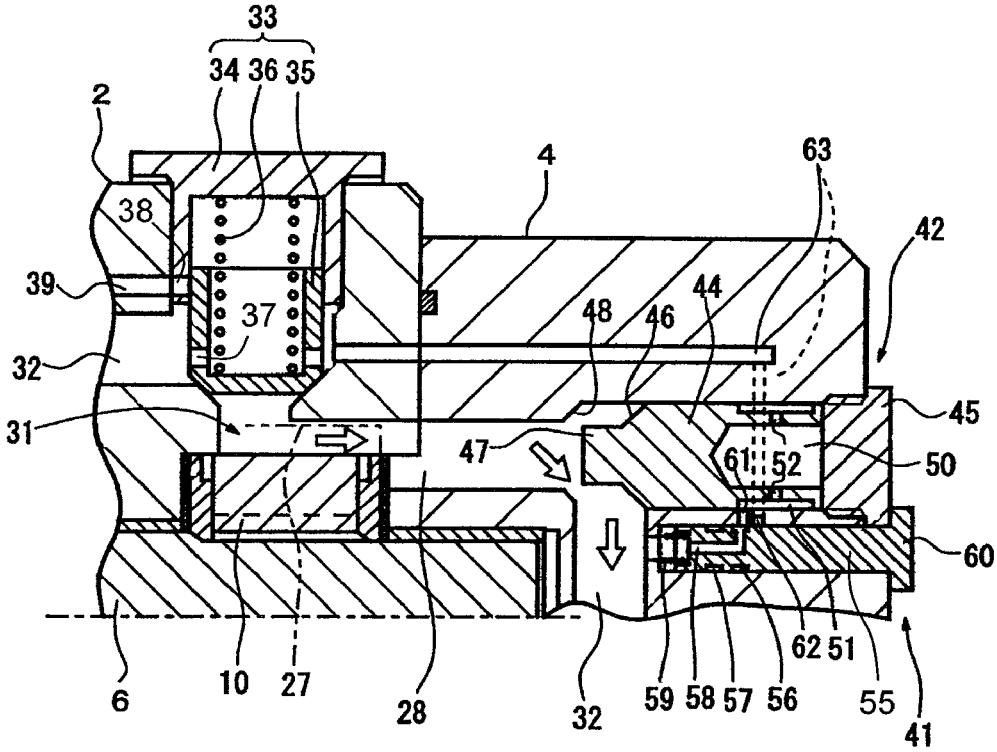
FIG. 6 is an enlarged cross sectional fragmentary view showing the check valve and the control valve during the operation of the variable displacement gear pump at 50% displacement.

FIGS. 4 through 6 show the change of operation of the gear pump from the 100% displacement to the 50% displacement. When the electromagnet 64 of the solenoid operated pilot valve 41 is energized during the 100% displacement operation of the gear pump, the magnetic force moves the plunger 65 forward against the urging force of the compressing spring 59 thereby to move the spool valve 55 to its forward-most position, as shown in FIG. 4. The annular groove 56 of the spool valve 55 is then in communication with the hole 61 while the annular groove 57 is spaced away from the hole 61 and the groove 62. Because the bypass passage 32 is closed by the control valve 42, the second passage of the bypass passage 32 has the same low pressure as the suction passage 24. Therefore, the oil in the space 50 of the valve member 44 and the valve hole 43 is flowed into the second passage of the bypass passage 32 through the communication passage 58. Thus, the space 50 and the valve hole 43 are placed under a reduced pressure (refer to FIG. 4).

Because the valve member 44 is subjected to the discharge pressure of the oil in the first passage of the bypass passage 32, the valve member 44 is moved rearward thereby to move the valve portion 46 of the valve member 44 away from the valve seat 48. Therefore, the oil discharged to the second discharge port 27 begins to flow into the bypass passage 32.

Because the valve member 44 opens the bypass passage 32 thereby to reduce the pressure loss, the valve member 35 of the check valve 33 is moved in the direction to close the discharge passage 28 by the urging force of the compression spring 36. In the early phase of the operation of the control valve 42 to open the bypass passage 32, however, the flow rate of the oil flowing into the second passage of the bypass passage 32 is restricted to a preset amount by the throttle passage 49. Thus, the flow rate of the oil is prevented from increasing rapidly and, therefore, the oil discharged from the main pump unit 30 is prevented from flowing backward from the discharge passage 28 into the bypass passage 32 (refer to FIG. 5).

The length of the throttle passage 49 is set in accordance with the moving speed of the valve member 35 of the check valve 33 that is determined by the strength of the compression spring 36, so that the flow rate of the oil flowing into the bypass passage 32 is restricted until the check valve 33 fully closes the discharge passage 28. Therefore, the oil hardly flows backward into the bypass passage 32 immediately before the check valve 33 fully closes the discharge passage 28, so that the generation of oil hammer is prevented successfully. Because the valve member 44 fully opens the bypass passage 32 after the check valve 33 fully closes the discharge passage 28, all the oil discharged from the auxiliary pump unit 31 flows into the suction passage 24. Therefore, only the oil discharged from the main pump unit 30 is supplied into the external hydraulic circuit (not shown) (refer to FIG. 6), and the oil supply is reduced, accordingly.

For returning the gear pump to its 100% displacement operation, the electromagnet 64 of the solenoid operated pilot valve 41 is deenergized. In this case, the spool valve 55 is moved rearward by the compression spring 59, so that the annular groove 57 communicates with the hole 61 and the groove 62 (refer to FIG. 3). The oil in the discharge passage 28 flows into the space 50 of the valve member 44 through the communication passage 63. Therefore, the valve member 44 is moved forward by the discharge pressure of the oil thereby to close the bypass passage 32. As the valve member 44 moves in the direction to close the bypass passage 32, the pressure loss in the first passage of the bypass passage 32 is increased, thereby moving the valve member 35 of the check valve 33 in the direction to open the discharge passage 28. Because the discharge passage 28 is fully opened when the valve member 44 fully closes the bypass passage 32, the oil discharged from the auxiliary pump unit 31 and the oil discharged from the main pump unit 30 join together in the discharge passage 28 and are delivered to the external hydraulic circuit (not shown) through the outlet port 29. It is noted that as the valve member 44 moves in the direction to close the bypass passage 32, the throttle passage 49 serves to regulate the flow of the oil flowing into the bypass passage 32. This regulation of the throttle passage 49 has an advantage in that the operation of the gear pump is changed from the 50% displacement to the 100% displacement smoothly. Therefore, the shock to the external hydraulic circuit (not shown) and the vibrations of the compression spring 36 are prevented.

The above-described first embodiment of the present invention offers the following advantageous effects.

(1) The provision of the throttle passage 49 in the bypass passage 32 makes possible changing the displacement of the gear pump slowly, which prevents rapid change of the flow of the oil flowing through the check valve 33. Therefore, the generation of oil hammer is prevented, and the shock and noise development of the external hydraulic circuit, the external hydraulic unit or the gear pump itself are prevented, accordingly.

(2) Because the check valve 33 is operated based on the balance of pressures, the compression spring 36 having a small spring constant is usable, which helps to make the check valve 33 simple and compact.

(3) If the compression spring 36 vibrates while the check valve 33 is being closed, the valve member 35 make an irregular operation by moving alternately between its closed position and open position. In such a case, the flow of oil in the main pump unit 30 becomes irregular and, therefore, there is fear that a constant amount of oil may fail to be supplied to the external hydraulic circuit (not shown). However, the throttle passage 49, which serves to prevent the generation of oil hammer, is expected to prevent also such vibrations of the compression spring 36 of the check valve 33.

(4) The throttle passage 49 serves to smoothen the change of the flow rate of the oil flowing through the check valve 33 and the control valve 42 when the gear pump is changed from the 50% displacement operation to the 100% displacement operation. Thus, the throttle passage 49 is expected to prevent the shock to the external hydraulic circuit (not shown) and the generation of vibrations of the compression spring 36 due to a rapid change of the flow rate of the oil.

(5) The control valve 42 has a cylindrical front end portion 47 that is movable into the bypass passage 32. The throttle passage 49 is a clearance formed between the outer circumferential surface of the cylindrical front end portion 47 and the inner peripheral surface of the bypass passage 32. Therefore, generation of oil hammer is prevented by a simple structure.

(6) The outer circumferential surface of the cylindrical front end portion 47 of the valve member 44 and the inner peripheral surface of the bypass passage 32 are parallel to the axis of the valve member 44 of the control valve 42. In this structure, machining for forming the throttle passage 49 is easy.

Figure 7:
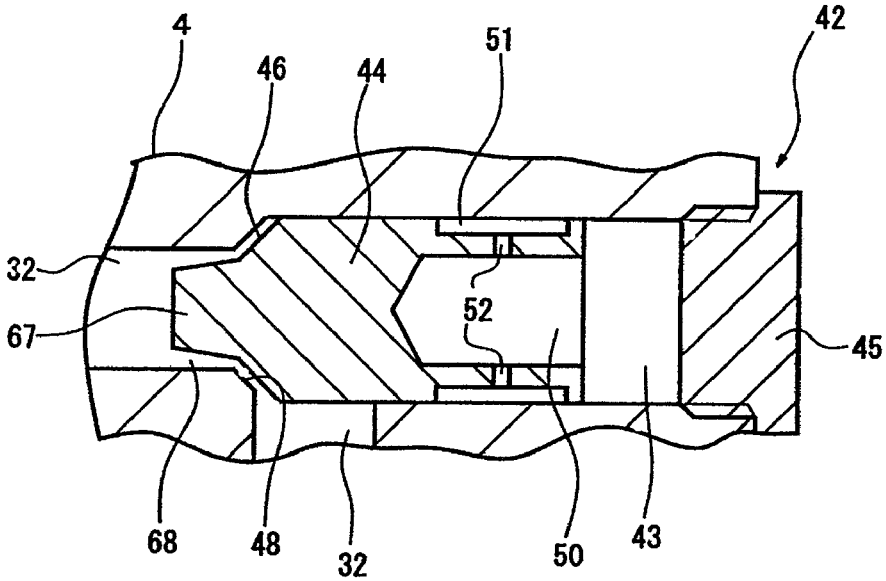
FIG. 7 is a cross sectional fragmentary view showing the control valve of a variable displacement gear pump according to a second embodiment of the present invention.

The following will describe the variable displacement gear pump according to the second embodiment of the present invention with reference to FIG. 7. The second embodiment differs from the first embodiment in that the shape of the throttle passage is modified. In the following description of the second and other embodiments, like reference numerals or symbols denote the like elements or parts of the gear pump used in the description of the first embodiment and the detailed description of such elements or parts will be omitted. In the second embodiment, the outer peripheral surface of the front end portion 67 of the valve member 44 is formed so as to taper forward. When the tapered front end portion 67 is moved into the first passage of the bypass passage 32, a throttle passage 68 is formed between the outer peripheral surface of the tapered front end portion 67 and the inner peripheral surface of the first passage of the bypass passage 32. The outer peripheral surface of the tapered front end portion 67 is so tapered that the clearance of the throttle passage 68 is reduced rearward. When the electromagnet 64 is energized during the operation of the gear pump at the 100% displacement, the plunger 65 is moved forward thereby to move the spool valve 55 forward. Because the pressure in the space 50 of the valve member 44 is then reduced, the valve member 44 is moved rearward. The flow rate of the oil flowing through the throttle passage 68 is relatively small during an early phase of the rearward movement of the valve member 44 to open the bypass passage 32. The flow rate of the oil flowing through the throttle passage 68 is gradually increased as the valve member 44 is moved further rearward.

In the second embodiment, the generation of oil hammer is prevented successfully as in the case of the first embodiment. The flow rate of oil flowing through the throttle passage 68 is increased with rearward movement of the valve member 44 to open the bypass passage 32. Therefore, the displacement changing of the gear pump is accelerated. In addition, when the tapered front end portion 67 is moved out of the bypass passage 32, the change of pressure in the bypass passage 32 is reduced. Furthermore, the flow rate of the oil is increased in later phase of the rearward movement of the valve member 44, so that an oil having low temperature or high viscosity may be used in the gear pump.

Figure 8:
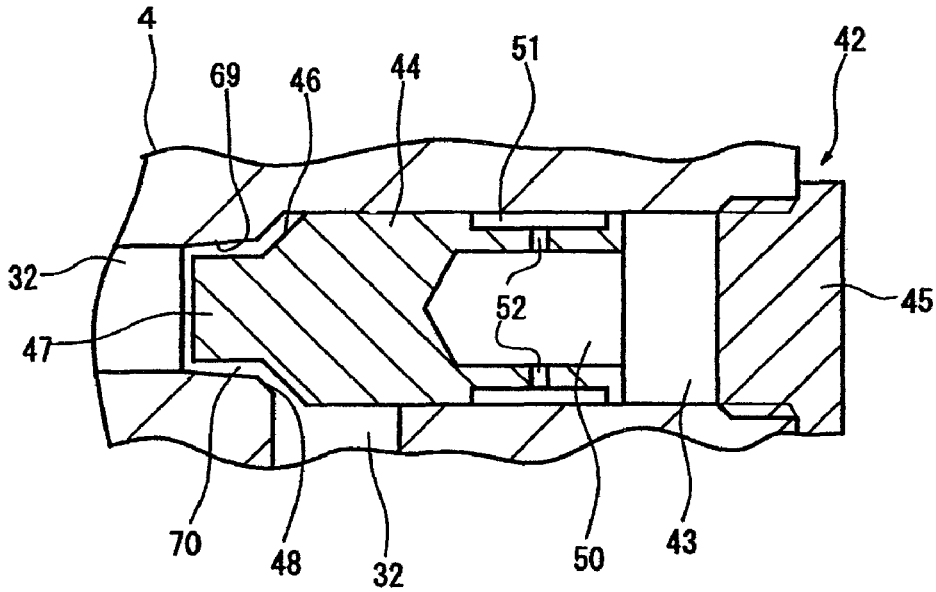
FIG. 8 is a cross sectional fragmentary view showing the control valve of a variable displacement gear pump according to a third embodiment of the present invention.

The following will describe the variable displacement gear pump according to the third embodiment of the present invention with reference to FIG. 8. The third embodiment differs from the first embodiment in that the shape of the throttle passage is modified. Specifically, the cylindrical front end portion 47 of the valve member 44 of the third embodiment is substantially the same as the counterpart of the first embodiment, but the first passage of the bypass passage 32 of the third embodiment is formed so that its cross sectional area increases toward the valve seat 48, as shown in FIG. 8. That is, the third embodiment differs from the second embodiment in that the tapered surface is formed on the inner peripheral surface 69 of the first passage of the bypass passage 32. The throttle passage 70 is formed between the outer circumferential surface of the cylindrical front end portion 47 and the tapered inner peripheral surface 69 of the first passage of the bypass passage 32 such that the cross sectional area thereof is reduced toward the front end of the throttle passage 70. The third embodiment offers the same effects as the second embodiment.

Figure 9:
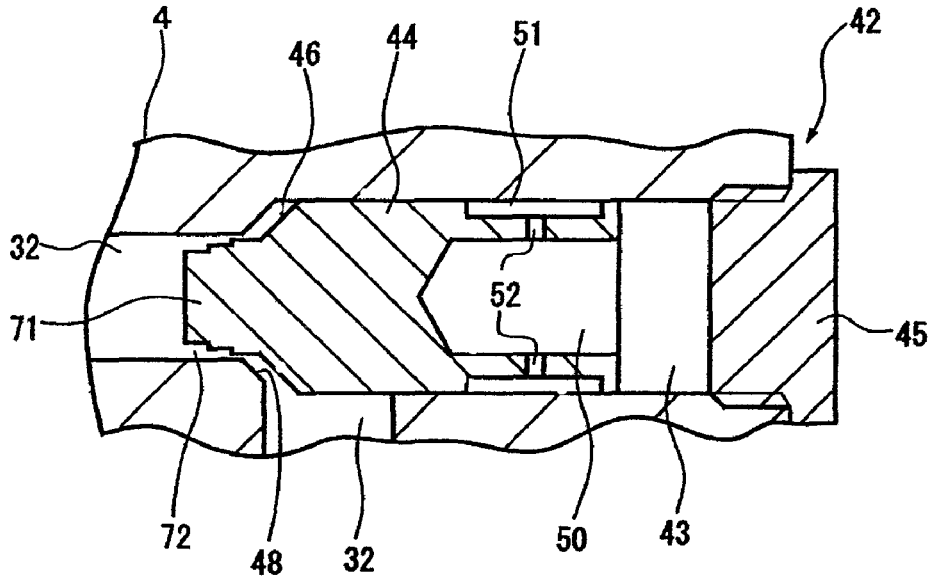
FIG. 9 is a cross sectional fragmentary view showing the control valve of a variable displacement gear pump according to a fourth embodiment of the present invention.

The following will describe the variable displacement gear pump according to the fourth embodiment of the present invention with reference to FIG. 9. The fourth embodiment differs from the first embodiment in that the shape of the throttle passage is modified. Specifically, the outer peripheral surface of the front end portion 71 of the valve member 44 is formed in a stepped shape so that the diameter of the front end portion 71 is reduced toward the front end thereof. The throttle passage 72 is formed between the outer peripheral surface of the stepped front end portion 71 and the inner peripheral surface of the first passage of the bypass passage 32 such that the cross sectional area thereof is reduced toward the rear end of the throttle passage 72. The fourth embodiment offers the same effects as the second embodiment.

Figure 10:
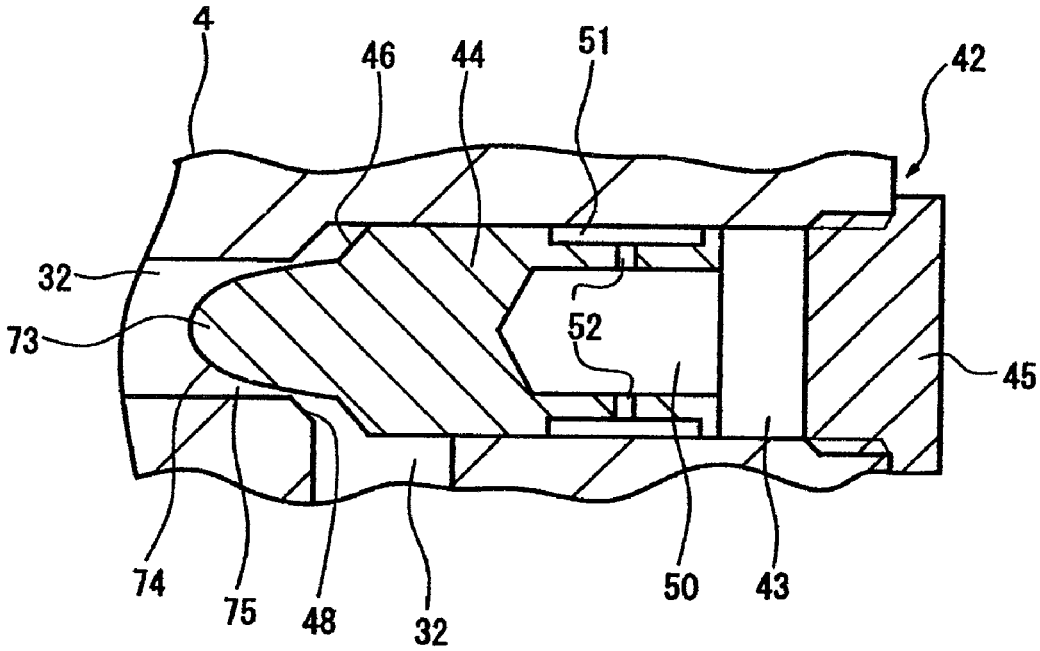
FIG. 10 is a cross sectional fragmentary view showing the control valve of a variable displacement gear pump according to a fifth embodiment of the present invention.

The following will describe the variable displacement gear pump according to the fifth embodiment of the present invention with reference to FIG. 10. The fifth embodiment differs from the first embodiment in that the shape of the throttle passage is modified. Specifically, the outer peripheral surface of the front end portion 73 of the valve member 44 is formed in a bullet shape having a curved surface. The throttle passage 75 is formed between the outer peripheral surface 74 of the bullet-shaped front end portion 73 and the inner peripheral surface of the first passage of the bypass passage 32 such that the cross sectional area thereof is reduced toward the rear end of the throttle passage 75. The fifth embodiment offers the same effects as the second embodiment.

The present invention has been described in the context of the above embodiments, but it is not limited to such embodiments. It is obvious to those skilled in the art that the invention may be practiced in various manners, as exemplified below.

In the above-described embodiments, the throttle passage 49 (68, 70, 72, 75) is provided by the clearance formed between the outer peripheral surface (74) of the front end portion 47 (67, 71, 73) of the valve member 44 of the control valve 42 and the inner peripheral surface of the first passage of the bypass passage 32. However, the throttle passage 49 (68, 70, 72, 75) is not limited to such a clearance, but it may be provided by a closable passage formed through the valve member 44.

Although in the above-described embodiments the control valve 42 is operated by the solenoid operated pilot valve 41, a pilot valve operable by a pressure differential may be used to the control valve 42.

Instead of using the solenoid operated pilot valve 41, the control valve 42 may be formed so that the space 50 of the valve member 44 is directly connected to the high pressure in the discharge passage 28 and the low pressure in the suction passage 21 (or 24) and a selector valve is provided between the discharge passage 28 and the space 50.

The variable displacement rotary pump of the present invention is not limited to the gear pump, but it may be of any other types of pump such as a screw pump, a vane pump or a roots-type pump.

What is claimed is:

1. A variable displacement rotary pump comprising:

a main pump unit having a first discharge port;

an auxiliary pump unit having a second discharge port;

a discharge passage in communication with the first discharge port and the second discharge port, wherein fluid in the first discharge port and fluid in the second discharge port join together in the discharge passage and are then discharged from the discharge passage;

a bypass passage in communication with the second discharge port;

a suction passage in communication with the bypass passage;

a check valve disposed in the discharge passage for preventing the fluid in the first discharge port from flowing into the bypass passage, wherein the check valve is operated by pressure of the second discharge port;

a control valve having a valve member for opening and closing the bypass passage, wherein when the valve member opens the bypass passage and the check valve closes the discharge passage, flow rate of the fluid that is discharged from the discharge passage is reduced, wherein the valve member has a cylindrical end portion that is movable into the bypass passage; and a throttle passage provided in the bypass passage or the control valve for regulating flow of the fluid in early phase of operation of the control valve to open the bypass passage, wherein the throttle passage is a clearance formed between an outer circumferential surface of the cylindrical end portion of the valve member and an inner peripheral surface of the bypass passage, and wherein a length of the throttle passage is set in accordance with a moving speed of the check valve so that a flow rate of fluid flowing into the bypass passage is restricted until the check valve fully closes the discharge passage.

2. The variable displacement rotary pump according to claim 1, wherein flow rate of the fluid flowing into the bypass passage is restricted until the check valve fully closes the discharge passage.

3. The variable displacement rotary pump according to claim 1, wherein the control valve opens the bypass passage fully after the early phase of operation of the control valve to open the bypass passage.

4. The variable displacement rotary pump according to claim 1, wherein during the operation of the control valve to open the bypass passage, a part of the valve member is moved out of the bypass passage and then the control valve opens the bypass passage fully.

5. The variable displacement rotary pump according to claim 1, wherein an outer peripheral surface of a part of the valve member that is disposed in the bypass passage and the inner peripheral surface of the bypass passage are parallel to an axis of the valve member of the control valve.

6. The variable displacement rotary pump according to claim 1, wherein the valve member has a part which is movable into the bypass passage, wherein the flow rate of the fluid flowing through the throttle passage is increased as the valve member is moved in a direction to open the bypass passage.

7. The variable displacement rotary pump according to claim 6, wherein an outer peripheral surface of the part of the valve member is formed in a tapered shape.

8. The variable displacement rotary pump according to claim 6, wherein an outer peripheral surface of the part of the valve member is formed in a bullet shape.

9. The variable displacement rotary pump according to claim 6, wherein the inner peripheral surface of the bypass passage is formed in a tapered shape.

10. The variable displacement rotary pump according to claim 6, wherein an outer peripheral surface of the part of the valve member is formed in a stepped shape.

11. The variable displacement rotary pump according to claim 1, wherein the rotary pump is a gear pump.

12. The variable displacement rotary pump according to claim 1, wherein the valve member has a space that is allowed to communicate with the discharge passage, wherein pressure of the space of the valve member acts on the valve member in a direction to close the bypass passage, wherein a pilot valve is provided for allowing the fluid in the space of the valve member to flow into an area of the bypass passage that is located downstream of the control valve or preventing the fluid in the space from flowing into the area of the bypass passage, wherein the pilot valve is operable to control operation of the control valve.

* * * * *